United States Patent [19]

Tamaki

[11] Patent Number: 4,660,518

[45] Date of Patent: Apr. 28, 1987

[54] IDLING RETURN DEVICE FOR INTERNAL COMBUSTION ENGINES

[75] Inventor: Sigeo Tamaki, Katsuta, Japan

[73] Assignee: Hitachi, Ltd., Tokyo, Japan

[21] Appl. No.: 823,019

[22] Filed: Jan. 27, 1986

[30] Foreign Application Priority Data

Jan. 25, 1985 [JP] Japan ..... 60-13018

[51] Int. Cl.[4] ..... F02M 3/05

[52] U.S. Cl. ..... 123/328; 123/401

[58] Field of Search ..... 123/328, DIG. 11, 360, 123/401

[56] References Cited

U.S. PATENT DOCUMENTS

| | | | |
|---|---|---|---|
| 3,621,824 | 11/1971 | Burnia et al. | 123/328 |
| 3,645,241 | 2/1972 | Huntzinger | 123/328 |
| 3,753,427 | 8/1973 | Cedar | 23/328 X |
| 3,830,213 | 8/1974 | Herman . | |
| 4,345,556 | 8/1982 | Crouillere | 123/328 X |
| 4,355,611 | 10/1982 | Hasegawa . | |
| 4,391,246 | 7/1983 | Kawabata et al. | 123/328 X |

FOREIGN PATENT DOCUMENTS

| | | |
|---|---|---|
| 787421 | 9/1935 | France . |
| 2269642 | 11/1975 | France . |
| 2663 | 1/1982 | Japan . |

OTHER PUBLICATIONS

Patent Abstracts of Japan, vol. 9, No. 245, Oct. 2, 1985; & JP-A-60 98 133 (Hitachi Seisakusho K.K.) 01-0-6-1985.

Patents Abstracts of Japan vol. 9, No. (M-365) [1786], Mar. 20, 1985; & JP-A-59 196 940 (Toyota Jidosha K.K.) 08-11-1984.

*Primary Examiner*—Tony M. Argenbright

*Attorney, Agent, or Firm*—Antonelli, Terry & Wands

[57] ABSTRACT

Compensation for misoperation of the return spring which is coupled to the throttle valve of an internal combustion engine is effected by way of a mechanism which monitors the operation of the engine. Upon detection of a deceleration condition, the mechanism, which may include a mechanical spring-coupled arrangement, an electromagnetic coupling element or a solenoid, operates to engage the throttle valve and rotate the throttle valve to a prescribed opening position slightly ahead of the normal ideal return position.

3 Claims, 8 Drawing Figures

IDLING RETURN DEVICE FOR INTERNAL COMBUSTION ENGINES

BACKGROUND OF THE INVENTION 1. (Field of the Invention)

The present invention relates to an idling return device for internal combustion engines and more particularly, to an idling return device for use with the throttle body of a carburetor or a mutipoint injection apparatus for internal combustion engines or to an idling return device for use with the throttle body for liquefied petroleum gas (LPG) internal combustion engines. The throttle body is provided with a throttle valve therein which is impelled by a return spring so as to be set at an idle opening.

2. (Description of the Prior Art)

As disclosed in the specification of Japanese Utility Model Publication No. 2663/1982, a conventional idling return device for internal combustion engines comprises a throttle body, a throttle valve provided within the throttle body, and a return spring for returning the throttle valve to a prescribed position. The return spring consists of a throttle valve return mechanism.

The conventional throttle valve is formed in such a manner that it is opened and closed in accordance with the accelerator pedal depressing force. Namely, the throttle valve having a throttle valve return mechanism consisting of a return spring, is formed in such a manner that the throttle valve returns (in the closing direction) toward an idle opening setting, as a result of the tensile force of the return spring when the accelerator pedal is no longer depressed.

However, when the return spring in a mechanism for returning the throttle valve by the action of the return spring is bent, the number of revolutions per minute of the engine crankshaft may become greater than a predetermined number even if the driver stops depressing the accelerator pedal. This may cause difficulty for the driver. Therefore, there has been a demand for a safety device for reliably closing the throttle valve when the driver stops depressing the accelerator pedal.

SUMMARY OF THE INVENTION

An object of the present invention is to provide an idling return device for internal combustion engines wherein a throttle valve can be reliably closed to an idle opening setting even when a return spring, which is provided to close the throttle valve when the accelerator pedal depressing force is no longer depressed, is broken or damaged.

Another object of the present invention is to provide an idling return device for internal combustion engines wherein a throttle valve can be returned forcibly by an idling return mechanism even when the throttle valve does not receive a sufficient resilient force to return the throttle valve to an idle opening setting by a return spring which is adapted to return the throttle valve when the accelerator pedal depressing force is no longer depressed.

A further object of the present invention is to provide an idling return device for internal combustion engines wherein an idling return mechanism can be adapted to operate only when the engine is decelerating.

Still another object of the present invention is to provide an idling return device for internal combustion engines wherein an idle return mechanism can adjust a throttle valve to an idle position by the vacuum force occuring at the downstream side of the throttle valve when the accelerator pedal is no longer depressed.

Still an additional object of the present invention is to provide an idling return device for internal combustion engines wherein an idling return mechanism can adjust a throttle valve to an idle position by an electromagnetic force when the accelerator pedal is no longer depressed.

The present invention is directed to an idling return device for internal combustion engines having a throttle valve which is formed so that the throttle valve is displaced or adjusted to an idle setting by a return spring, so that the throttle valve is opened against the tensile force of the return spring when the accelerator pedal is depressed. The throttle valve controls the flow rate of air or a gaseous mixture of air and fuel. The idling return device is provided with an idling return mechanism for automatically closing the throttle valve to an idling position when the throttle valve is displaced in the closing direction by the return spring to a position which is slightly ahead of the position corresponding to the idling position.

The idling return device of the present invention comprises a conventional throttle valve return mechanism consisting of a return spring and further comprises the above-described idling return mechanism.

The idling return mechanism of the present invention comprises the toggle joint of a diaphragm utilizing the suction vacuum of an engine, or an electromanetic force member, and is adapted to be operated only when the engine is decelerating, and not when the engine is decelerating.

The idling return device for internal combustion engines according to the present invention is capable of reliably closing the throttle valve to an idling position even when the return spring, which is provided to close the throttle valve when the accelerator pedal is no longer depressed, is broken or damaged, and to improve the safety of the vehicle.

DETAILED DESCRIPTION OF THE PREFERRED EMBODIMENTS

Figure 1:
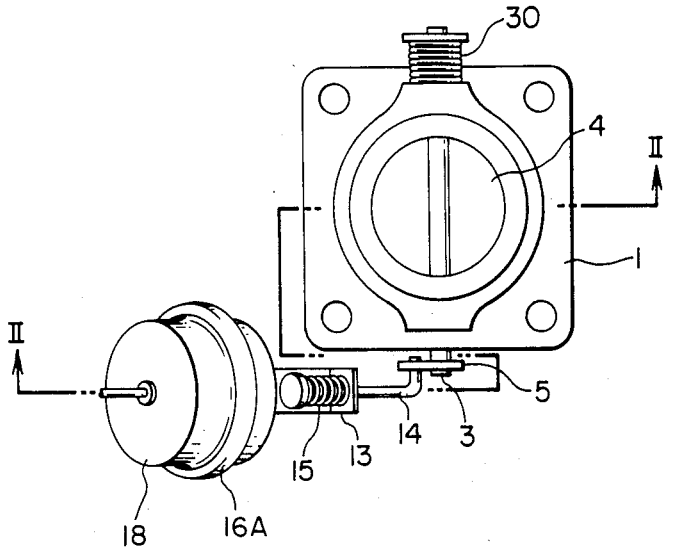
FIG. 1 is a plan view of an embodiment of an idling return device for internal combustion engines having an idling return mechanism according to the present invention.

An idling return device for internal combustion engines having an idling return mechanism according to the present invention will now be described with reference to FIGS. 1–4.

An air valve body or throttle body 1 has a suction passage 2 therein. A throttle valve 4 is provided with a throttle valve shaft 3. The throttle valve shaft 3 passes through the air valve body 1 and has mounted thereon a return spring 30 surrounding the throttle valve shaft 3 at one end thereof, in the same manner as a conventional throttle valve return mechanism.

The throttle valve 4 returns in the closing direction toward an idling position in response to the tensile force of the return spring 30 when the accelerator pedal is no longer depressed. The throttle valve 4 controls the flow rate of air or gaseous mixture of air and a fuel.

The idling setting is generally at an angle of about less than 1° for a throttle body employed in a multipoint injection apparatus for internal combustion engines and is generally at an angle of about 1°–3° for the throttle body of a carburetor for internal combustion engines.

A lever 5 is fixed at the other end of the throttle valve shaft 3 and is rotates around the throttle valve shaft 3. The lever 5 is rotatably coupled to one end of an operating rod 14 of an idling return mechanism 16A.

A suction vacuum discharge port 7 is provided in a portion 6 of the suction passage 2. The suction vacuum discharge port 7 communicates with the downstream side of the throttle valve 4.

A vacuum passage 8 communicates at one end thereof with the suction vacuum discharge port 7. The vacuum passage 8 communicates at the other end thereof with a vacuum chamber 9 in a casing 18. The vacuum passage 8 has an orifice 17 at an intermediate portion thereof.

A diaphragm 11 divides the interior of the casing 18 into vacuum chamber 9 and an atmospheric chamber 20 which communicates with the atmosphere. The diaphragm 11 is urged within the vacuum chamber 9 toward the atmospheric chamber 20 by a diaphragm spring 10.

A lower stopper 12 is fixed to the diaphragm 11. The lower stopper 12 has a free end 12*a*. The free end 12*a* of the lower stopper 12 contacts the inner surface of the casing 18.

An operating member 13 is fixed at one end thereof to the portion of the diaphragm 11 within the atmospheric chamber 20. The operating member 13 is made of single plate and is formed in a L sectional shape. The operating member 13 may be made of a cylindrical tube, etc.

The inner end of an operating rod 14 is fixed through an operating spring 15 to the inside of the other end portion of the operating member 13 so that the operating rod 14 is drawn into the interior of the operating member 13.

A locking portion or locking member 14*a* of the operating rod 14 engages a stopper 13*a* of the operating member 13 fixed to the inner end surface of the operating member 13. Locking portion 14*a* is formed on a longitudinally intermediate section of the operating rod 14. The section of the locking portion 14*a* of the operating rod 14 is confined within the operating member 13 while the throttle valve 4 is closed. Namely, the locking portion 14*a* of the operating rod 14 is formed on the section shown in FIG. 2 of the operating rod 14.

In this embodiment, the idling return mechanism 16A consists of the casing 18 having vacuum chamber 9 and atmospheric chamber 20. The vacuum chamber 9 communicates through vacuum passage 8 with the portion 6 of the suction passage 2 at the downstream side of the throttle valve 4 and is separated from atmospheric chamber 20 by the diaphragm 11 is and provided with the diaphragm spring 10 therein. The diaphragm 11 is urged toward atmospheric chamber 20 by the diaphragm spring 10. The atmospheric chamber 20 communicates with the atmosphere. The operating member 13 is fixed at one end portion thereof to the diaphragm 11 within the atmospheric chamber 20 and, at the other end portion thereof, engage operating rod 14, so that the operating rod 14 is fixed at one end thereof through the operating spring 15 to the inside of the second-mentioned end portion of the operating member 13 in such a manner that the operating rod 14 is drawn into the interior of the operating member 13. The lever 5 rotates the throttle valve shaft 3 of the throttle valve 4. The lever 5 is coupled to the end portion of the operating rod 14 which projects from the operating member 13. The locking member 14*a* is provided on the operating rod 14 and is adapted to engage the stopper 13*a*. The stopper 13*a* is fixed to the inner side of the operating member 13 that is on the side of the lever 5, when the operating rod 14 is displaced in the throttle valve-opening direction. When the operating rod 14 is displaced toward the casing 18, the operating spring 15 is compressed.

The idling return device of this embodiment of the present invention is provided with the idling return mechanism 16A for automatically closing the throttle valve 4 to the idling position when the throttle valve 4 is displaced in the closing direction by the return spring 30 to a position which is slightly ahead of the position corresponding to the idling position.

The throttle valve 4 is formed so that it is opened when the accelerator pedal is depressed, and closed to the idling position in response to the tensile force of the return spring 30 when the accelerator pedal is no longer depressed.

Figure 2:
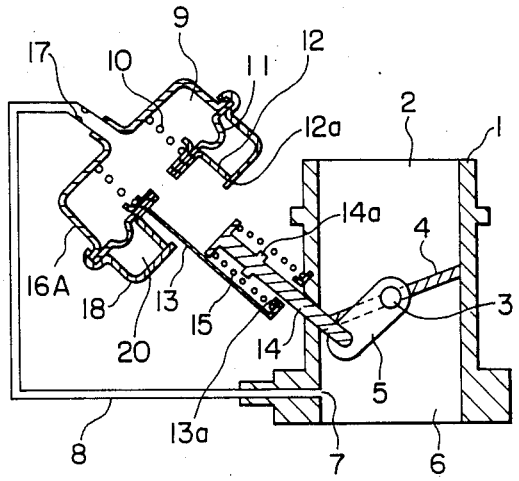
FIG. 2 is a sectional view of an embodiment of the idling return device for internal combustion engines taken a line II—II of FIG. 1, in which the idling return mechanism has begun to operate.

FIG. 2 shows the relative positions of the components of the idling return mechanism of the present invention during the idling state. In the idling state, a vacuum in the portion of the suction passage 2 which is on the downstream side of the throttle valve 4 is introduced from the suction vacuum discharge port 7 into the vacuum chamber 9 in the idling return mechanism 16A through the vacuum passage 8, and the diaphragm 11 overcomes the tensile force of the diaphragm spring 10 to draw the operating member 13 thereto.

Accordingly, the throttle valve 4 is closed to the idling position, and the vacuum at the downstream side of the throttle valve 4 decreases. The diaphragm 11 is displaced by the diaphragm spring 10, and the free end 12*a* of the lower stopper 12 engages the inner surface of the atmospheric chamber 20 with the operating spring 15 being in an extended state.

Figure 5:
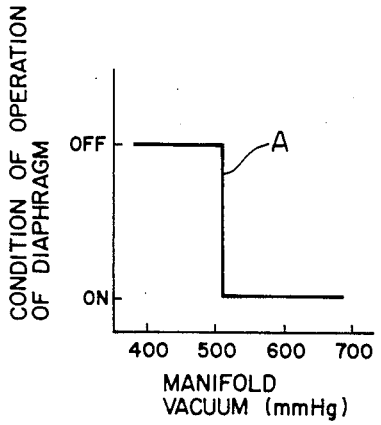
FIG. 5 is a diagram illustrating the change in manifold vacuum with respect to the lapse of time during the operation of the idling return mechanism for internal combustion engines.

When the suction vacuum in the suction passage 2 is lower than a predetermined level during idling, the diaphragm spring 10 is not operated as shown by a curve A in FIG. 5 in which the lateral and longitudinal axes represent manifold vacuum and the operational condition of the diaphragm 11, respectively.

The operating spring 15 is formed so as to have a tensile force less than that of the return spring 30 by which the throttle valve 4 is returned when the accelerator pedal is no longer depressed. The locking portion 14*a* of the operating rod 14 and the stopper 13*a* of the operating member 13 are spaced apart from each other. The operating spring 15 is also adapted to absorb vibration between the operating member 13 and the operating rod 14.

Figure 3:
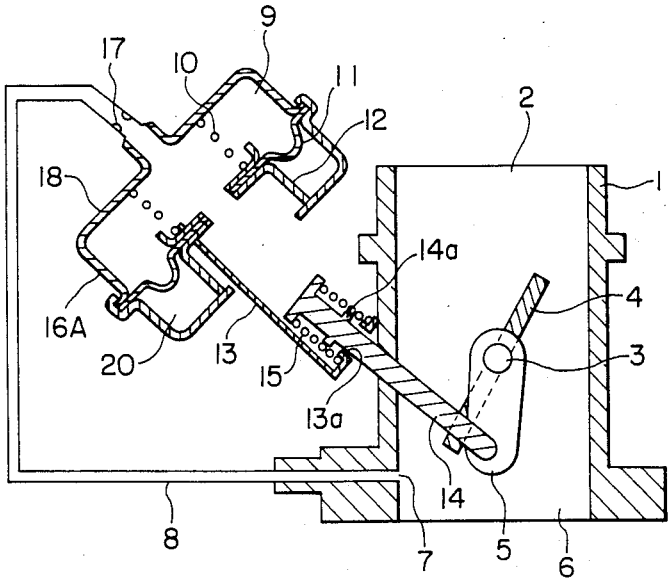
FIG. 3 is a sectional view of the idling return device for internal combustion engines of FIG. 2 during the acceleration of the engine with the throttle valve opened.

FIG. 3 shows the relative positions of the components of the idling return mechanism of the present invention during the state of acceleration. In this condition the suction vacuum is lower than a set level (in this case about 520–530 mm Hg) as shown in FIG. 5.

Accordingly, the diaphragm 11 in the idling return mechanism 16A is not operated, and only the operating rod 14 is displaced in accordance with the movement of the lever 5 as it partially compresses operating spring 15. During this time, the locking portion 14*a* of the operating rod 14 does not contact the stopper 13*a* of the operating member 13.

When the engine is being accelerated, a slightly larger force as compared with a conventional device, as required in order to compress the operating spring 15 when the accelerator pedal is depressed. Otherwise the operation of this embodiment is no different from that of a conventional device. During this time, the idling return mechanism 16A is not in operation.

Figure 4:
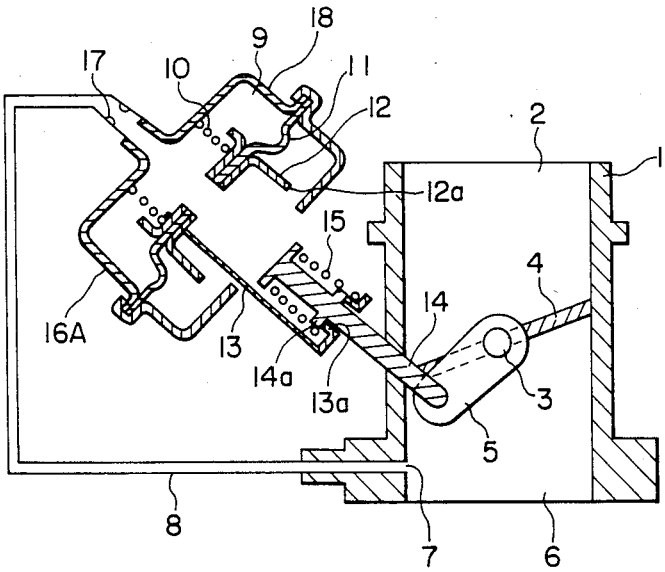
FIG. 4 is a sectional view of the idling return device for internal combustion engines of FIG. 2, in which the idling return mechanism is operated by vacuum pressure.

FIG. 4 shows the relative positions of components when the engine has just begun to decelerate. Due to deceleration, the suction vacuum in the suction passage 2 becomes high enough to cause the vacuum in the vacuum chamber 9 to increase to a high level, and the diaphragm 11 overcomes the tensile force of the diaphragm spring 10, so that the diaphragm 11 moves back with the operating member 13.

Consequently, the operating spring 15 is compressed, and the locking portion 14*a* of the operating rod 14 engages the stopper 13*a* of the operating member 13. The operating rod 14 is drawn into the operating member 13, so that the throttle valve 4 is closed to the idling position.

As a result, the throttle valve 4 mounted on the throttle valve shaft 3 can be returned forcibly by the idling return mechanism 16A even when the throttle valve 4 does not receive sufficient resilient force to return the throttle valve 4 to the idle position from the return spring 30, which is adapted to return the throttle valve 4 when the accelerator pedal is no longer depressed or when the return spring 30 is damaged.

Figure 6:
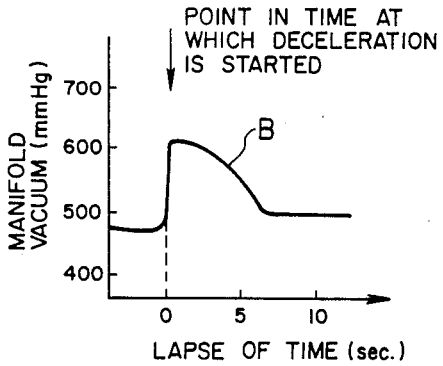
FIG. 6 is a diagram illustrating the relationship between manifold vacuum and the operation of the diaphragm in the idling return mechanism for internal combustion engines.

The idling return mechanism 16A is adapted to be operated by a vacuum when the engine is decelerated. Accordingly, the idling return mechanism 16A can be operated forcibly for at least several seconds while the suction vacuum is higher than a set level (in this case about 520–530 mm Hg), as shown by a curve B in FIG. 6 in which the lateral and longitudinal axes represent time and manifold vacuum, respectively.

In order to control the time of operation, orifice 17 is provided at an intermediate portion of the vacuum passage 8. This enables the time of operation to be increased.

The idling return mechanism 16A can be applied to the throttle body of a carburetor or the throttle body of a multipoint injection apparatus of an internal combustion engine, or the throttle body of an LPG internal combustion engine.

This idling return machanism 16A is capable of closing the throttle valve 4 to the idle position by the tensile force of the diaphragm spring 10 and the operating spring 15 even when a suction vacuum is not applied.

As described above, this embodiment of the idling return device for internal combustion engines having the idling return mechanism 16A is capable of closing the throttle valve 4 to the idle position by a suction vacuum force occurring at the downstream side of the throttle valve 4, when the accelerator pedal is no longer depressed.

The invention operates even when the return spring 30, which is provided to close the throttle valve 4 when the accelerator pedal is no longer depressed, is broken or damaged. This improved the safety of operation of the vehicle.

Figure 7:
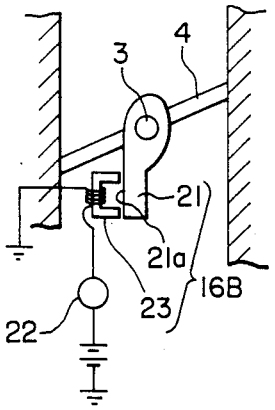
FIG. 7 illustrates another embodiment of the idling return device for internal combustion engines having an idling return mechanism according to the present invention.
Figure 8:
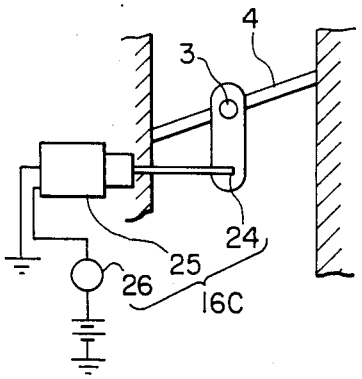
FIG. 8 illustrates a further embodiment of the idling return device for internal combustion engines having an idling return mechanism according to the present invention.

FIGS. 7 and 8 show further embodiments of the present invention. In the previously-described embodiment, a high suction vacuum at the downstream side of the throttle valve 4 is detected to operate the idling return mechanism 16A. In both of the embodiments of FIGS. 7 and 8 the throttle valve 4 is closed to an idle position by an electromagnetic force when the throttle valve 4 is moved to a position slightly ahead of the idle position.

The embodiment shown in FIG. 7 employs an electromagnet as an electromagnetic force member. In this embodiment, an electromagnet 23 as an electromagnetic force member is disposed adjacent an end portion 21*a* of a throttle lever 21. When the accelerator pedal is no longer depressed, an idling return mechanism 16B is turned on and off automatically by the force of the electromagnet 23.

The time for energizing the electromagnet 23 is controlled through a computer 22 in accordance with the condition of the engine which is detected by a gear switch, an engine rotating switch, a vacuum sensor, an acceleration sensor, etc.

If the electromagnet 23 attracts the throttle lever 21 with a large force, especially, when the engine is to be accelerated, the driver cannot move the vehicle in a desired manner. Such an inconvenience can be eliminated by controlling the electromagnet 23 through computer 22.

In this embodiment, the idling return mechanism 16B comprises the throttle lever 21 mounted on the throttle valve shaft 3 of the throttle valve 4, the electromagnet 23 disposed opposite the end portion 21*a* of the throttle lever 21, and computer 22 for controlling the time for energizing the electromagnet 23.

FIG. 8 shows an embodiment utilizing a solenoid 25 consisting of an electromagnetic force member. The solenoid 25 is provided in a similar manner as the electromagnet 23 in the embodiment shown in FIG. 7 and is adapted to be controlled through a computer 26 when the engine is decelerated when the accelerator pedal is no longer depressed.

In this embodiment, an idling return mechanism 16C comprises a throttle lever 24 mounted on the throttle valve shaft 3 of the throttle valve 4, the solenoid 25 connected to the throttle lever 24, and the computer 26 for controlling the time for energizing solenoid 25.

The above two embodiments of the present invention having the idling return mechanisms 16B and 16C utilizing the electromagnetic force members 23 and 25 shown in FIGS. 7 and 8 also have the same or similar operation and effect as the embodiment having the idling return mechanism 16A utilizing the toggle joint of the diaphragm using the suction vacuum of the engine shown in FIGS. 1–4.

I claim:

1. For use with an internal combustion engine having a throttle valve for controlling the flow rate of air or gaseous mixture of air and fuel to the engine, the throttle valve being coupled with a return spring, for returning the throttle valve to an engine idle position, so that, in response to the depression of an accelerator pedal, the throttle valve is opened against the force of the return spring, an idling return device comprising:

first means for detecting a deceleration condition of said engine comprising a casing having a vacuum chamber and an atmospheric chamber communicating with the atmosphere and being separated from said vacuum chamber by a diaphragm therebetween, a vacuum passageway coupled between said vacuum chamber and a portion of a suction passage containing said throttle valve downstream of the throttle valve, and a diaphragm spring urging said diaphragm in a direction of said atmospheric chamber and thereby effectively increasing the volume of said vacuum chamber; and second means coupled to said first means, for automatically displacing said throttle valve to a position slightly ahead of the idle position thereof in response to said first means detecting the deceleration condition of said engine comprising an operating member coupled at one end thereof to said diaphragm and being coupled at the other end thereof to an operating spring which extends therefrom in a direction towards said diaphragm, an operating rod, one end of which is coupled to an end of said operating spring opposite the end thereof extending from the other end of said operating member, so that said operating rod is urged by said spring member toward said diaphragm, a lever affixed at one end thereof to said throttle valve and being rotationally coupled at a second end thereof to said operating rod, and wherein said operating rod contains a locking portion that is adapted to be engaged by a stopper portion of said other end of said operating member such that in response to the opening of said throttle valve, said operating rod is displaced in a direction away from said diaphragm, compressing said operating spring thereby urging said operating member and said diaphragm coupled thereto in a direction to increase the volume of said vacuum chamber.

2. An idling return device according to claim 1, wherein the tensile force of said operating spring is less than a value that would close the throttle valve during depression of the accelerator pedal, but of a sufficiently large valve to urge the throttle valve to a closed idle position in response to said first means detecting a deceleration condition of said engine.

3. An idling return device according to claim 1, wherein said vacuum passageway includes at least one orifice therein for controlling the time of operation of said first means.

* * * * *